US011011043B2

(12) United States Patent
Nazhan

(10) Patent No.: US 11,011,043 B2
(45) Date of Patent: May 18, 2021

(54) GENERATING ALARMS FOR A DRILLING TOOL

(71) Applicant: Chevron U.S.A. Inc., San Ramon, CA (US)

(72) Inventor: Anmar Nazhan, Humble, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 11 days.

(21) Appl. No.: 16/293,284

(22) Filed: Mar. 5, 2019

(65) Prior Publication Data

US 2020/0286361 A1 Sep. 10, 2020

(51) Int. Cl.
*G08B 21/18* (2006.01)
*E21B 21/08* (2006.01)

(52) U.S. Cl.
CPC ..... *G08B 21/182* (2013.01); *E21B 21/08* (2013.01)

(58) Field of Classification Search
CPC ..... G08B 21/182; E21B 21/08
See application file for complete search history.

(56) References Cited

U.S. PATENT DOCUMENTS 5,474,142 A * 12/1995 Bowden ..... E21B 44/02 175/162
6,401,838 B1 * 6/2002 Rezmer-Cooper ..... E21B 21/08 175/38
2004/0124009 A1 * 7/2004 Hoteit ..... G06N 7/005 175/25
2011/0153296 A1 * 6/2011 Sadlier ..... E21B 44/00 703/7
2015/0204182 A1 * 7/2015 Andarawis ..... E21B 47/0001 166/255.1
2015/0226012 A1 * 8/2015 Zhou ..... E21B 7/00 175/57
2015/0308253 A1 * 10/2015 Clark ..... E21B 33/085 175/24
2016/0097270 A1 * 4/2016 Pobedinski
2016/0312558 A1 * 10/2016 Cavalheiro
2017/0191359 A1 * 7/2017 Dursun ..... E21B 47/12
2018/0216423 A1 * 8/2018 Henriksen ..... E21B 19/161
(Continued)

FOREIGN PATENT DOCUMENTS

WO WO-2016023068 A1 * 2/2016 ..... E21B 44/00

*Primary Examiner* — Steven Lim
*Assistant Examiner* — Kevin Lau
(74) *Attorney, Agent, or Firm* — Esplin & Associates, PC

(57) ABSTRACT

A set of alarm criteria for a drilling tool may be obtained. Individual alarm criterion of the set of alarm criteria may be satisfied based on the drilling tool operating with a set of operating characteristics corresponding to the individual alarm criterion. The set of alarm criteria may include two or more of a tight-hole alarm criterion, a washout alarm criterion, a packoff alarm criterion, a weight-stacking alarm criterion, a delta-torque alarm criterion, a torque alarm criterion, a rate-of-penetration alarm criterion, a reamer-tension-compression alarm criterion, a running-speed alarm criterion, a drag alarm criterion, and/or a pipe-movement alarm criterion. An alarm event corresponding to an alarm criterion may be detected based on the operating characteristic(s) of the drilling tool matching the set of operating characteristics corresponding to the alarm criterion. Responsive to detection of the alarm event, an alarm for the alarm event may be generated.

26 Claims, 7 Drawing Sheets

(56) References Cited

U.S. PATENT DOCUMENTS

| | | | | |
|---|---|---|---|---|
| 2018/0238164 | A1* | 8/2018 | Jamison | G05B 13/027 |
| 2018/0266233 | A1* | 9/2018 | Ahmed | E21B 47/042 |
| 2020/0182038 | A1* | 6/2020 | Soukup | |

* cited by examiner

GENERATING ALARMS FOR A DRILLING TOOL

FIELD

The present disclosure relates generally to the field of generating alarms for a drilling tool.

BACKGROUND

Non-productive time (NPT) during drilling operations may significantly increase the cost of drilling. Monitoring of drilling operations are focused on well control and safety rather than efficiency of drilling operations and reduction of NPT.

SUMMARY

This disclosure relates to generating alarms for a drilling tool. Operating characteristic information for a drilling tool may be obtained. The operating characteristic information may define one or more operating characteristics of the drilling tool. A set of alarm criteria for the drilling tool may be obtained. Individual alarm criterion of the set of alarm criteria may be satisfied based on the drilling tool operating with a set of operating characteristics corresponding to the individual alarm criterion. The set of alarm criteria may include a first alarm criterion that is satisfied based on the drilling tool operating with a first set of operating characteristics corresponding to the first alarm criterion. The set of alarm criteria may include two or more of a tight-hole alarm criterion, a washout alarm criterion, a packoff alarm criterion, a weight-stacking alarm criterion, a delta-torque alarm criterion, a torque alarm criterion, a rate-of-penetration alarm criterion, a reamer-tension-compression alarm criterion, a running-speed alarm criterion, a drag alarm criterion, a pipe-movement alarm criterion, and/or other alarm criteria. An alarm event corresponding to the first alarm criterion may be detected based on the operating characteristic(s) of the drilling tool matching the first set of operating characteristics corresponding to the first alarm criterion. Responsive to detection of the alarm event, an alarm for the alarm event may be generated.

A system that generates alarms for a drilling tool may include one or more electronic storage, one or more processors and/or other components. The electronic storage may store information relating to a drilling tool, operating characteristic information, information relating to an operation of the drilling tool, information relating to operating characteristics of the drilling tool, information relating to alarm criteria for the drilling tool, information relating to sets of operating characteristics corresponding to individual alarm criteria, information relating to alarm events, information relating to alarms, and/or other information.

The processor(s) may be configured by machine-readable instructions. Executing the machine-readable instructions may cause the processor(s) to facilitate generating alarms for a drilling tool. The machine-readable instructions may include one or more computer program components. The computer program components may include one or more of an operating characteristic component, an alarm criteria component, an alarm event component, an alarm generation component, and/or other computer program components.

The operating characteristic component may be configured to obtain operating characteristic information for a drilling tool and/or other information. The operating characteristic information may define one or more operating characteristics of the drilling tool. The operating characteristic information may define operating characteristic(s) of the drilling tool at one or more moments during operation of the drilling tool.

The alarm criteria component may be configured to obtain a set of alarm criteria for the drilling tool. Individual alarm criterion of the set of alarm criteria may be satisfied based on the drilling tool operating with a set of operating characteristics corresponding to the individual alarm criterion. For example, the set of alarm criteria may include a first alarm criterion and/or other alarm criteria. The first alarm criterion may be satisfied based on the drilling tool operating with a first set of operating characteristics corresponding to the first alarm criterion. The set of alarm criteria may include two or more of a tight-hole alarm criterion, a washout alarm criterion, a packoff alarm criterion, a weight-stacking alarm criterion, a delta-torque alarm criterion, a torque alarm criterion, a rate-of-penetration alarm criterion, a reamer-tension-compression alarm criterion, a running-speed alarm criterion, a drag alarm criterion, a pipe-movement alarm criterion, and/or other alarm criteria.

Different alarm criteria may correspond to different sets of operating characteristics. For example, the set of operating characteristics corresponding to the tight-hole alarm criterion may include a trend of deviation of pick-up weight. The trend of deviation of the pick-up weight may include the pick-up weight deviating from a slack-off weight.

The set of operating characteristics corresponding to the washout alarm criterion may include a decrease in pressure of flowrate in accordance with a washout profile. The set of operating characteristics corresponding to the washout alarm criterion may further include movement directions of multiple components of the drilling tool.

The set of operating characteristics corresponding to the packoff alarm criterion may include an increase in pressure of flowrate in accordance with a packoff profile.

The set of operating characteristics corresponding to the weight-stacking alarm criterion may include a decrease in rate-of-penetration to zero, a steady or an increase in weight-on-bit, a change in torque, and a steady rotation speed.

The set of operating characteristics corresponding to the delta-torque alarm criterion may include a deviation of torque from weight-on-bit.

The set of operating characteristics corresponding to the torque alarm criterion may include a change in torque exceeding an expected variance.

The set of operating characteristics corresponding to the rate-of-penetration alarm criterion may include a decrease in rate-of-penetration, a steady rotation speed, and a steady weight-on-bit.

The set of operating characteristics corresponding to the reamer-tension-compression alarm criterion may include an average of weight-on-bit over a duration being less than a neutral weight.

The set of operating characteristics corresponding to the running-speed alarm criterion may include a rotation speed of a bottom hole assembly exceeding a maximum rotation speed.

The set of operating characteristics corresponding to the drag alarm criterion may include a trend of deviation of drag.

The set of operating characteristics corresponding to the pipe-movement alarm criterion may include a duration of no bottom hole assembly movement within a depleted formation exceeding a maximum hold duration for the depleted formation.

The alarm event component may be configured to detect an alarm event corresponding to the first alarm criterion. The alarm event corresponding to the first alarm criterion may be detected based on the operating characteristic(s) of the drilling tool matching the first set of operating characteristics corresponding to the first alarm criterion and/or other information.

The alarm generation component may be configured to, responsive to detection of the alarm event, generate an alarm for the alarm event. The alarm may be generated local to and/or remote from the drilling tool. The alarm may include a visual component, an audio component, a haptic component, and/or other components.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a," "an," and "the" include plural referents unless the context clearly dictates otherwise.

DETAILED DESCRIPTION

The present disclosure relates to generating alarms for a drilling tool. The methods and systems of the present disclosure may use different operating characteristics of a drill tool to detect events that indicate potential issues for the drilling tool's operation. Early warning alarms may be generated to notify users about the potential issues. The alarms may be generated in advance of issues becoming serious enough to cause non-productive time and to allow the users to check on and address issues before they become exacerbated.

Figure 1:
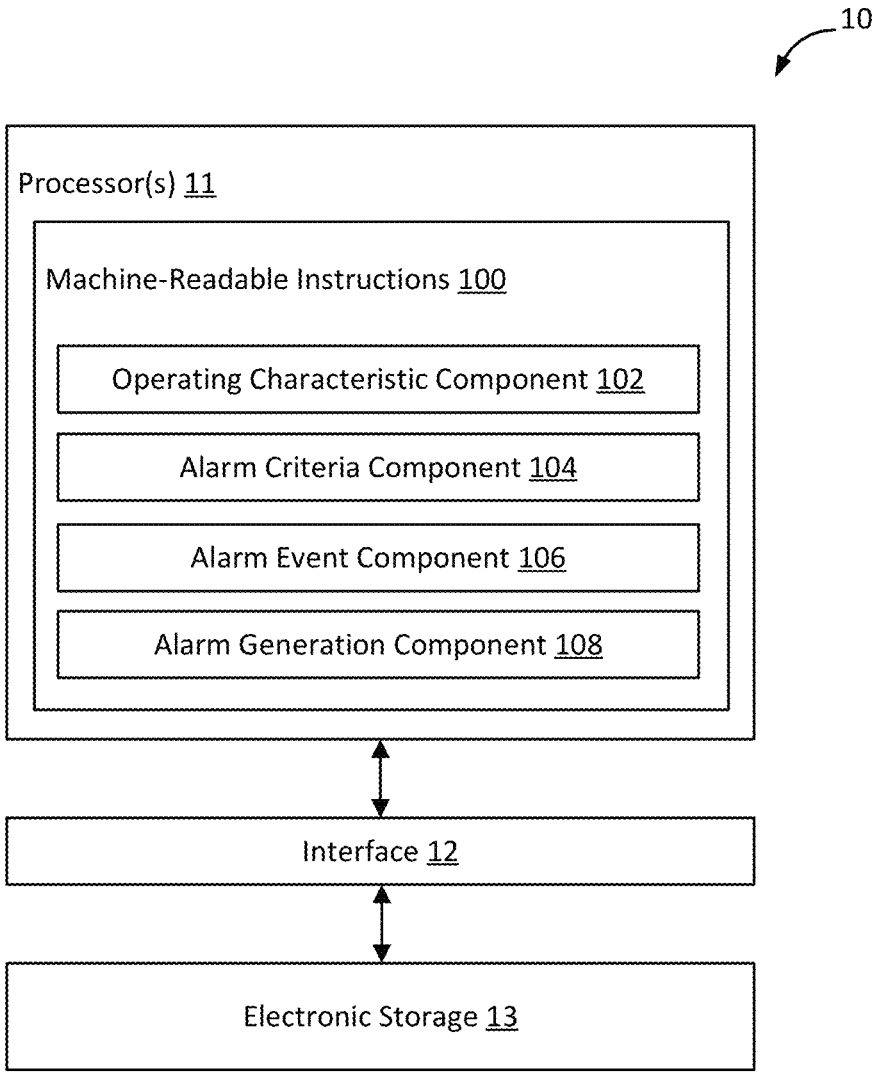
FIG. 1 illustrates an example system that generates alarms for a drilling tool.

The methods and systems of the present disclosure may be implemented by and/or in a computing system, such as a system 10 shown in FIG. 1. The system 10 may include one or more of a processor 11, an interface 12 (e.g., bus, wireless interface), an electronic storage 13, and/or other components.

Operating characteristic information for a drilling tool may be obtained by the processor 11. The operating characteristic information may define one or more operating characteristics of the drilling tool. A set of alarm criteria for the drilling tool may be obtained by the processor 11. Individual alarm criterion of the set of alarm criteria may be satisfied based on the drilling tool operating with a set of operating characteristics corresponding to the individual alarm criterion. The set of alarm criteria may include an alarm criterion that is satisfied based on the drilling tool operating with a set of operating characteristics corresponding to the alarm criterion. The set of alarm criteria may include two or more of a tight-hole alarm criterion, a washout alarm criterion, a packoff alarm criterion, a weight-stacking alarm criterion, a delta-torque alarm criterion, a torque alarm criterion, a rate-of-penetration alarm criterion, a reamer-tension-compression alarm criterion, a running-speed alarm criterion, a drag alarm criterion, a pipe-movement alarm criterion, and/or other alarm criteria. An alarm event corresponding to the first alarm criterion may be detected by the processor 11 based on the operating characteristic(s) of the drilling tool matching the set of operating characteristics corresponding to the alarm criterion. Responsive to detection of the alarm event, an alarm for the alarm event may be generated by the processor 11.

A drilling tool may refer to a device or an implement designed and/or used for drilling. A drilling tool may be designed and/or used to drill one or more substances. For example, a drilling tool may include a rock drilling tool for drilling into and/or through rock (e.g., sedimentary rock). A drilling tool to may refer to one or more portions of a device/implement that performs the drilling. A drilling tool may refer to portions of or entirety of a device/implement that performs drilling. For example, a drilling tool may refer to one or more portions of a drilling rig and/or the entirety of the drilling rig. Other drilling tools are contemplated.

The electronic storage 13 may be configured to include electronic storage medium that electronically stores information. The electronic storage 13 may store software algorithms, information determined by the processor 11, information received remotely, and/or other information that enables the system 10 to function properly. For example, the electronic storage 13 may store information relating to a drilling tool, operating characteristic information, information relating to an operation of the drilling tool, information relating to operating characteristics of the drilling tool, information relating to alarm criteria for the drilling tool, information relating to sets of operating characteristics corresponding to individual alarm criteria, information relating to alarm events, information relating to alarms, and/or other information.

The processor 11 may be configured to provide information processing capabilities in the system 10. As such, the processor 11 may comprise one or more of a digital processor, an analog processor, a digital circuit designed to process information, a central processing unit, a graphics processing unit, a microcontroller, an analog circuit designed to process information, a state machine, and/or other mechanisms for electronically processing information. The processor 11 may be configured to execute one or more machine-readable instructions 100 to facilitate generating alarms for a drilling tool. The machine-readable instructions 100 may include one or more computer program components. The machine-readable instructions 100 may include one or more of an operating characteristic component 102, an alarm criteria component 104, an alarm event component 106, an alarm generation component 108, and/or other computer program components.

The operating characteristic component 102 may be configured to obtain operating characteristic information for a drilling tool and/or other information. Obtaining operating characteristic information may include one or more of accessing, acquiring, analyzing, determining, examining, identifying, loading, locating, opening, receiving, retrieving, reviewing, storing, utilizing, and/or otherwise obtaining the operating characteristic information.

The operating characteristic component 102 may obtain operating characteristic information from one or more locations. For example, the operating characteristic information component 102 may obtain operating characteristic information from a storage location, such as the electronic storage 13, electronic storage of information and/or signals generated by one or more sensors monitoring operating characteristics of the drilling tool and/or one or more components of the sensor(s), electronic storage of a device accessible via a network, and/or other locations. Sensor(s) monitoring operating characteristics of the drilling tool may be part of, may be coupled to, and/or may be remote from the drilling tool. The operating characteristic information component 102 may obtain operating characteristic information from one or more hardware components (e.g., a sensor, a component of the drilling tool) and/or one or more software components (e.g., software running on a computing device).

The operating characteristic component 102 may obtain operating characteristic information defining different operating characteristics of the drilling tool at the same time or at different times. The operating characteristic component 102 may obtain operating characteristic information defining different operating characteristics of the drilling tool from a single location or from multiple locations.

The operating characteristic information may define one or more operating characteristics of the drilling tool. The operating characteristic information may define operating characteristic(s) of the drilling tool at one or more moments during operation of the drilling tool. A moment may include one or more points in time and/or one or more durations of time.

An operating characteristic of a drilling tool may refer to one or more features and/or one or more qualities of the drilling tool during operation. An operating characteristic of a drilling tool may include one or more operating parameters that are controlled and/or set to operate the drilling tool in a particular manner. An operating characteristic of a drilling tool may include one or more values of operating parameter (s) that define the operation of the drilling tool. An operating characteristic of a drilling tool may include status of how a drilling component is being used (e.g., whether a component is being used, the translational and/or rotational direction of movement of a component). An operating characteristic of a drilling tool may include one or more conditions of the environment around and/or near the drilling tool. An operating characteristic of a drilling tool may include one or more values of environmental condition(s) and/or near the drilling tool. An operating characteristic of a drilling tool may be determined based on one or more other operating characteristics of the drilling tool. An operating characteristic of a drilling tool may include combination of one or more other operating characteristics of the drilling tool (e.g., a trend of torque and flowrate).

For example, operating characteristic(s) of the drilling tool defined by the operating characteristic information may include one or more of, and/or combinations of, drilling depth, total gas present, hookload, depth of bit, block position, torque (e.g., TQA torque), rotation speed (e.g., rotation per minute), rate of penetration, weight on bit, standpipe pressure, flowrate, pressure, mud weight in/out, active pit total, volume change, hole displacement, tank volume, strokes speed (e.g., strokes per minute), pump rate, equivalent circulating density, equivalent static density, whether one or more pumps are on or off, pick-up weight, slack-off weight, direction of movement of bit depth, direction of movement of block position, reamer neutral weight, bottom hole assembly speed (e.g., feet per minute), drag, block weight, friction factor, and/or other operating characteristic(s).

Operating characteristic(s) of the drilling tool defined by the operating characteristic information may define which of the parameters and/or conditions are relevant, values of the parameters and/or conditions, status of the drilling tool, and/or other information relating to the operation of the drilling tool. In some implementations, operating characteristic(s) of the drilling tool defined by the operating characteristic information may include values corresponding to one or more moments, calculated values (e.g., minimum, maximum, average, curve), and/or values from which other parameters values may be determined (e.g., calculated).

The alarm criteria component 104 may be configured to obtain a set of alarm criteria for the drilling tool. Obtaining a set of alarm criteria may include one or more of accessing, acquiring, analyzing, determining, examining, identifying, loading, locating, opening, receiving, retrieving, reviewing, storing, utilizing, and/or otherwise obtaining the set of alarm criteria. For example, a set of alarm criteria may be stored within one or more files, and the alarm criteria component 104 may obtain the set of alarm criteria by obtaining the file(s). A set of alarm criteria may be coded into one or more logics, one or more functions, one or more operations, and/or one or more programs and the alarm criteria component 104 may obtain the set of alarm criteria by obtaining the logic(s), the function(s), the operation(s), and/or the program(s).

A set of alarm criteria for the drilling tool may include one or more alarm criteria for the drilling tool. An alarm criterion may refer to one or more standards by which an occurrence of one or more problematic and/or potentially problematic events for the drilling tool may be detected. An alarm criterion may define one or more factors that may be used to detect whether such an event has occurred and/or is occurring. An alarm criterion may define one or more operating characteristics (a set of operating characteristics) which, when found during the operation of the drilling tool, may indicate the occurrence of the problematic and/or potentially problematic event(s) for the drilling tool.

An alarm criterion may be satisfied based on the drilling tool operating with one or more sets of operating characteristics corresponding to the alarm criterion. For example, an alarm criterion may define one or more sets of operating characteristics for a particular event, and the drilling tool operating with the set(s) of operating characteristics corresponding to the alarm criterion may satisfy alarm criteria and may indicate the occurrence of the particular event. The drilling tool operating with the set(s) of operating characteristics corresponding to the alarm criterion may include the operation characteristic(s) of the drilling tool matching the set(s) of operating characteristics corresponding to the alarm criterion.

An alarm criterion may define one or more workflows and/or one or more logics for comparing operating characteristic(s) of the drilling tool with the set(s) of operating characteristics corresponding to the alarm criterion. A workflow and/or logic may include one or more steps to compare operating characteristic(s) of the drilling tool with the set(s) of operating characteristics. A workflow and/or logic may define particular operating characteristics of the drilling tool (input parameters) to be used in the comparison. A workflow and/or logic may include direct comparison of particular operating characteristic(s) to the set(s) of operating characteristics. A workflow and/or logic may include indirect comparison of particular operating characteristic(s) to the set(s) of operating characteristics, such as computation of value(s) from the particular operating characteristic(s) and the comparison of the computed value(s) to the set(s) of operating characteristics. A workflow and/or logic may include comparison of data (e.g., real-time data, historical data) to other types of data and/or information, such as comparison to historical data, data models of drilling operations, historical trends, known patterns in drilling operations, and/or other data/information.

The set of alarm criteria may include one or more alarm criteria for detecting events that may cause/potentially cause decreased drilling efficiency and/or non-productive time for the drilling tool. For example, the set of alarm criteria may include one or multiples (e.g., two or more) of the following alarm criteria: a tight-hole alarm criterion, a washout alarm criterion, a packoff alarm criterion, a weight-stacking alarm criterion, a delta-torque alarm criterion, a torque alarm criterion, a rate-of-penetration alarm criterion, a reamer-tension-compression alarm criterion, a running-speed alarm criterion, a drag alarm criterion, a pipe-movement alarm criterion, and/or other alarm criteria. The set of alarm criteria including multiples of the alarm criteria may include the set of alarm criteria including different types of alarm criteria and/or multiple versions of the same alarm criterion. For example, one set of alarm criteria may include a tight-hole alarm criterion and a washout alarm criterion, and another set of alarm criterion may include two versions of the tight-hold alarm criterion. The different versions of the same alarm criterion may be used to detect different levels (e.g., intensity, urgency) of the same type of event.

Different alarm criteria may correspond to different sets of operating characteristics. For example, the set(s) of operating characteristics corresponding to the tight-hole (hole cleaning) alarm criterion may include a trend of deviation of pick-up weight, and/or other operating characteristic(s). The trend of deviation of the pick-up weight may include the pick-up weight deviating from a slack-off weight. The trend of deviation of the pick-up weight may include the pick-up weight deviating from the slack-off weight over drilling depth and/or drilling time. The set(s) of operating characteristics corresponding to the tight-hole alarm criterion may specify values (e.g., one or more specific values, one or more ranges of values) and/or types of separation of the pick-up weight from the slack-off weight (e.g., profiles of separation) that need to be observed during operation of the drilling tool to satisfy the tight-hole alarm criterion.

The tight-hole alarm criterion may include same or different sets of operating characteristics for detecting a tight-hole and/or determining one or more parameters (e.g., slack-off weight) under different operating conditions (e.g., drilling operations vs tripping operations). For example, factors to satisfy the tight-hole alarm criterion and/or to determine slack-off weight under a drilling operation may include one or more of the following: bit depth being within 150 ft from hole depth; rotation speed being less than 5 rotations per minute; pumps being on or off. Factors to satisfy the tight-hole alarm criterion and/or to determine slack-off weight under a tripping operation may include one or more of the following: bit depth being between 800 ft and 150 ft from hole depth (hole depth—150'); rotation speed being less than 5 rotations per minute; pumps being on or off. Other values and types of operating characteristics required to satisfy the tight-hole alarm criterion are contemplated.

The set(s) of operating characteristics corresponding to the washout alarm criterion may include a decrease in pressure of flowrate in accordance with a washout profile, and/or other operating characteristic(s). A washout may include one or more cracks in a pipe, which may lead to loss in pressure. A washout profile may define one or more decreases in pressure (e.g., rate of decrease, acceleration of decrease, decrease curve) that need to be observed during operation of the drilling tool to satisfy the washout alarm criterion.

The set(s) of operating characteristics corresponding to the washout alarm criterion may further include movement directions of multiple components of the drilling tool. For example, the set(s) of operating characteristics corresponding to the washout alarm criterion may specify one or more directions of movement of the drill tool component(s) that needs to be observed during operation of the drilling tool to satisfy the washout alarm criterion. For instance, the set(s) of operating characteristics may require the bit depth to move in an opposite direction of the movement of the block position to satisfy the washout alarm criterion. The set(s) of operating characteristics may define one or more relationships (e.g., cause and effect relationship among drill tool components, relationships between drilling parameters) to filter out false positives of a washout event. Other values and types of operating characteristics required to satisfy the washout alarm criterion are contemplated.

The set(s) of operating characteristics corresponding to the packoff alarm criterion may include an increase in pressure of flowrate in accordance with a packoff profile, and/or other operating characteristic(s). A packoff may include cuttings being accumulated on a bit and/or a bottom hole assembly. A certain amount of accumulation may result in loss of circulation. A packoff profile may define one or more increase in pressure (e.g., rate of increase, acceleration of increase, increase curve) that need to be observed during operation of the drilling tool to satisfy the packoff alarm criterion. The set(s) of operating characteristics corresponding to the packoff alarm criterion may further include movement directions of multiple components of the drilling tool, such as those similar to or opposite of the washout alarm criterion. Other values and types of operating characteristics required to satisfy the packoff alarm criterion are contemplated.

The set(s) of operating characteristics corresponding to the weight-stacking alarm criterion may include a decrease in rate-of-penetration to zero, a steady or an increase in weight-on-bit, a change in torque, a steady rotation speed, and/or other operating characteristic(s). Weight stacking may include weight being applied not properly being transferred to one or more bottom hole assembly components, such as a bit (e.g., due to a sleeve hanging on a wall of a well and taking weight from the bit). The set(s) of operating characteristics corresponding to the weight-stacking alarm criterion may specify values (e.g., one or more specific values, one or more ranges of values) and/or types of decreases/increases of the rate-of-penetration, weight-on-bit, and/or torque that need to be observed during operation of the drilling tool to satisfy the weight-stacking alarm criterion. For example, factors to satisfy the weight-stacking alarm criterion may include one or more of the following: the rate-of-penetration decreases to zero; a steady (constant, relatively constant) or an increase in weight-on-bit; a (significant) decrease in torque (TQA); and a steady (constant, relatively constant) rotation speed (rotation per minute).

The weight-stacking alarm criterion may include same or different sets of operating characteristics for detecting weight-stacking under different operating conditions (e.g., for fully rotating sleeve, for non-rotating sleeve). For example, factors to satisfy the weight-stacking alarm criterion while using a fully rotating sleeve may be different from factors to satisfy the weight-stacking alarm criterion while using a non-rotating sleeve. For example, weight-stacking alarm criterion may specify different types of profiles for fully rotating sleeve and for non-rotating sleeve. Other values and types of operating characteristics required to satisfy the weight-stacking alarm criterion are contemplated.

The set(s) of operating characteristics corresponding to the delta-torque alarm criterion may include a deviation of torque from weight-on-bit, and/or other operating characteristic(s). A deviation of torque from weight-on-bit may include abnormal change in torque (e.g., TQA) with respect to the weight-on-bit. The set(s) of operating characteristics corresponding to the delta-torque alarm criterion may specify values (e.g., one or more specific values, one or more ranges of values) and/or types of separation of the torque from the weight-on-bit (e.g., profiles of separation) that need to be observed during operation of the drilling tool to satisfy the delta-torque alarm criterion. Other values and types of operating characteristics required to satisfy the delta-torque alarm criterion are contemplated.

The set(s) of operating characteristics corresponding to the torque alarm criterion may include a change in torque exceeding an expected variance, and/or other operating characteristic(s). The set(s) of operating characteristics corresponding to the torque alarm criterion may specify values (e.g., one or more specific values, one or more ranges of values) and/or types of torque exceeding the expected variance (e.g., exceeding profiles) that need to be observed during operation of the drilling tool to satisfy the torque alarm criterion. The set(s) of operating characteristics may define one or more relationships (e.g., relationships between drilling parameters and expected changes in torque) to filter out false positives of a torque alarm event. Other values and types of operating characteristics required to satisfy the torque alarm criterion are contemplated.

The set(s) of operating characteristics corresponding to the rate-of-penetration alarm criterion may include a decrease in rate-of-penetration, a steady rotation speed, a steady weight-on-bit, and/or other operating characteristic(s). Rate-of-penetration alarm may indicate a change in formation encountered by the drilling tool. For example, a shale formation may have less porosity than other types of rock formation, and transition from the shale formation to another rock formation may be detected based on the penetration alarm. The set(s) of operating characteristics corresponding to the rate-of-penetration alarm criterion may specify values (e.g., one or more specific values, one or more ranges of values) and/or types of decreases of the rate-of-penetration, while the rotation speed and the weight-on-bit remains steady (constant, relatively constant), that need to be observed during operation of the drilling tool to satisfy the rate-of-penetration alarm criterion. For example, factors to satisfy the rate-of-penetration alarm criterion may include one or more of the following: the rate-of-penetration decreases; a steady (constant, relatively constant) rotation speed (rotation per minute); a steady (constant, relatively constant) weight-on-bit. Other values and types of operating characteristics required to satisfy the rate-of-penetration alarm criterion are contemplated.

The set(s) of operating characteristics corresponding to the reamer-tension-compression alarm criterion may include an average of weight-on-bit over a duration being less than a neutral weight, and/or other operating characteristic(s). The neutral weight of a reamer may refer to the weight of the reamer when only the force of gravity is acting on the reamer. A reamer may need to remain in compression with a bit (e.g., the reamer has weight exceeding its neutral weight) for proper operating of the drilling tool. If the reamer is in tension with the bit (e.g., because not enough force is being applied on the reamer), the reamer may experience excessive vibrations. The set(s) of operating characteristics corresponding to the reamer-tension-compression alarm criterion may specify values (e.g., one or more specific values, one or more ranges of values) and/or relative weights by which the weight-on-bit must be less than the neutral weight. For example, factors to satisfy the reamer-tension-compression alarm criterion may include the average weight-on-bit over a duration of time (e.g., 2 minutes) being less than the neutral weight. Other values and types of operating characteristics required to satisfy the reamer-tension-compression alarm criterion are contemplated.

The set(s) of operating characteristics corresponding to the running-speed alarm criterion may include a rotation speed of a bottom hole assembly exceeding a maximum rotation speed, and/or other operating characteristic(s). The set(s) of operating characteristics corresponding to the running-speed alarm criterion may specify values (e.g., one or more specific values, one or more ranges of values) and/or types of rotating speed exceeding the maximum rotation speed (e.g., exceeding profiles) that need to be observed during operation of the drilling tool to satisfy the running-speed alarm criterion. Other values and types of operating characteristics required to satisfy the running-speed alarm criterion are contemplated.

The set(s) of operating characteristics corresponding to the drag alarm criterion may include a trend of deviation of drag, and/or other operating characteristic(s). Excessive drag encountered during drilling operation may lead to and/or indicate the drilling tool becoming stuck and/or a hole cleaning problem. The set(s) of operating characteristics corresponding to the drag alarm criterion may specify values (e.g., one or more specific values, one or more ranges of values) and/or types of separation of the drag from the one or more trends of drag that need to be observed during operation of the drilling tool to satisfy the drag alarm criterion. Other values and types of operating characteristics required to satisfy the delta-torque alarm criterion are contemplated.

The set(s) of operating characteristics corresponding to the pipe-movement alarm criterion may include a duration of no bottom hole assembly movement within a depleted formation exceeding a maximum hold duration for the depleted formation, and/or other operating characteristic(s). If a bottom hole assembly remains within a depleted formation for a certain duration of time, the difference in pressure may grab and hold the bottom hole assembly, which may lead to a stuck-pipe event. The set(s) of operating characteristics corresponding to the pipe-movement alarm criterion may specify values (e.g., one or more specific values, one or more ranges of values) of duration for which the bottom hole assembly must not move (must remain) within a depleted formation during operation of the drilling tool to satisfy the pipe-movement alarm criterion. The durations of time for which no bottom hole assembly movement are required to be observed during operation of the drilling tool may depend on the type of formation/depleted formation. Other values and types of operating characteristics required to satisfy the pipe-movement alarm criterion are contemplated.

The alarm event component 106 may be configured to detect one or more alarm events corresponding to one or more alarm criteria. An alarm event corresponding to an alarm criterion may be detected based on the operating characteristic(s) of the drilling tool matching the set(s) of operating characteristics corresponding to the alarm criterion and/or other information. An operating characteristic of the drilling tool matching an operating characteristic corresponding to an alarm criterion may include the operating characteristic of the drilling tool being the same as the operating characteristic corresponding to the alarm criterion. An operating characteristic of the drilling tool matching an operating characteristic corresponding to an alarm criterion may include the operating characteristic of the drilling tool being within one or more thresholds of the operating characteristic corresponding to the alarm criterion.

The alarm event component 106 may utilize one or more workflows and/or one or more logics of an alarm criterion to perform one or more comparison of the operating characteristic(s) of the drilling tool with the set(s) of operating characteristics corresponding to the alarm criterion. The alarm event component 106 may utilize one or more of signal processing and/or comparison of data from the operating characteristic information with factors of the alarm criterion to determine whether the operating characteristic(s) of the drilling tool matches the set(s) of operating characteristics corresponding to the alarm criterion. The comparison may include comparison of data (e.g., real-time data, historical data) to historical data, data models of drilling operations, historical trends, known patterns in drilling operations, and/or other comparisons.

For example, comparison of the operating characteristic(s) of the drilling tool with the set(s) of operating characteristics corresponding to the tight hole alarm criterion may include comparative trend analysis of pick-up weight and/or slack-off weight, and/or analysis of other information. A trend of separation between the pick-up weight and the slack-off weight may be compared to model curve(s) (e.g., planned curves, historical curves, known curves) of separation between the pick-up weight and the slack-off weight. Based on a certain amount, rate, and/or profile of deviation of the pick-up weight from the slack-off weight (e.g., compared to model curves), an alarm event corresponding to the tight hole alarm criterion may be detected. An alarm event corresponding to the tight hole alarm criterion may be detected based on a certain trend change in the deviation of the pick-up weight from the slack-off weight.

Figure 3:
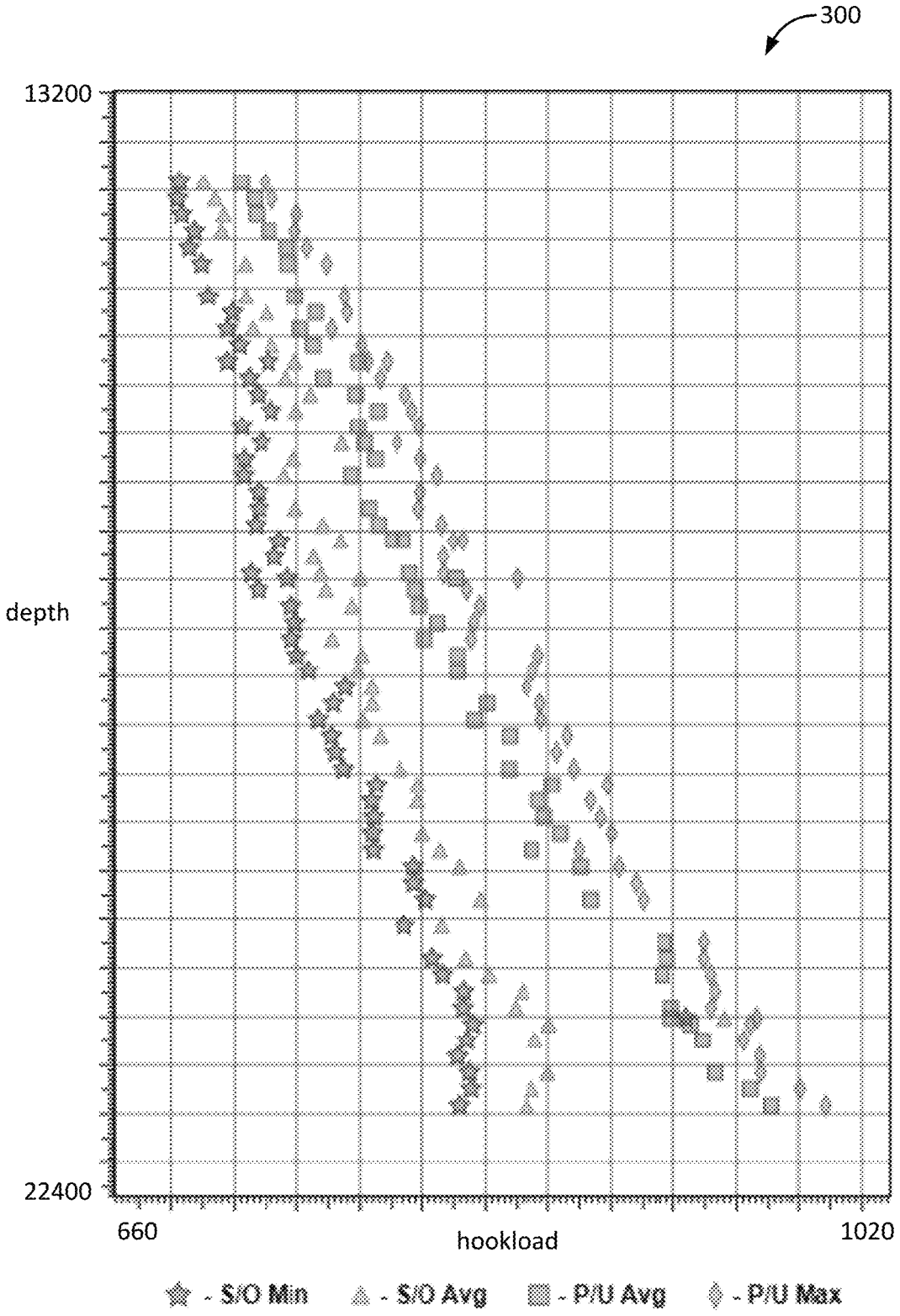
FIG. 3 illustrates an example plot of pick-up weight and slack-off weight.

For example, FIG. 3 illustrates an example plot 300 of pick-up weight and slack-off weight. The plot 300 may show measured hookload of the pick-up weight (e.g., average, maximum) and the slack-off weight (e.g., minimum, average) as a function of depth. The residual of separation between the pick-up weight and the slack-off weight may be measured to identify a particular trend of deviation between the pick-up weight and the slack-off weight. For instance, a continuous separation of the pick-up weight and the slack-off weight over a depth range may indicate an occurrence of an alarm event (e.g., anomaly) corresponding to the tight hole alarm criterion. The comparison may include use of multi-regression analysis to fill in any gaps in measurement of the pick-up weight and/or the slack-off weight. For instance, measurements of the pick-up weight and the slack-off weight may not line up in time and/or depth, and multi-regression analysis may be used to determine the value of the pick-up weight and/or the slack-off weight to be used for comparison. The comparison may automatically adjust for status of pumps (on or off) during measurement of the pick-up weight and the slack-off weight. The comparison may carry the effect of pumps being on or off in the measurement and/or in the adjustment of the pick-up weight and the slack-off weight, enabling comparison of pick-up weight and the slack-off weight regardless of whether the pumps were on or off. Other detections of alarm events corresponding to the tight hole alarm criterion are contemplated.

Figure 4:
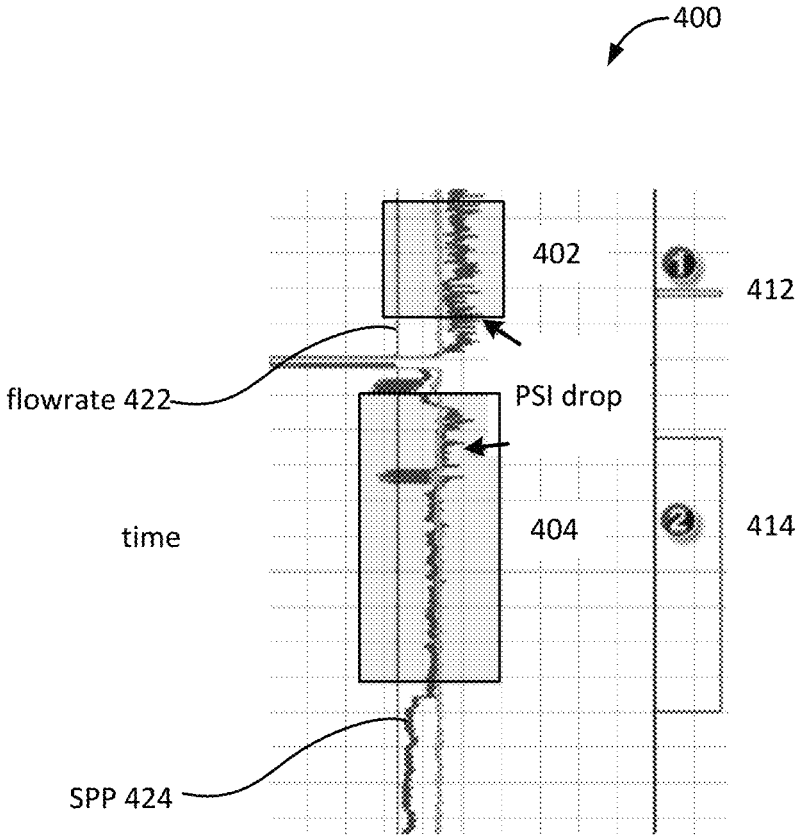
FIG. 4 illustrates example curves of flowrate and pressure.

Comparison of the operating characteristic(s) of the drilling tool with the set(s) of operating characteristics corresponding to the washout alarm criterion may include analysis of pressure, flowrate, and/or other information to detect a particular decrease in flowrate. Based on a certain amount, rate, and/or profile of decrease in pressure for a flowrate, an alarm event corresponding to the washout alarm criterion may be detected. For example, FIG. 4 illustrates plot 400 of example curves of flowrate 422 and stand pipe pressure (SPP) 424 over time. The SPP 424 may be fluctuating (such as in regions 402, 404), and a user looking at the curve of SPP 424 may not be able to detect a particular profile of decrease in pressure indicating the occurrence of a washout alarm event. In some implementations, the scale of the profile of decrease in pressure (e.g., 30 PSI) may be much smaller in comparison to the scale of the overall pressure fluctuation (e.g., 6000 PSI), making any such manual comparison difficult or impossible.

The comparison performed by the alarm event component 106 may include use of signal processing and/or pattern recognition to determine when the pressure experiences a decrease (e.g., actual decrease in pressure, pressure remains steady when pressure increase was expected, smaller increase than expected, larger decrease than expected) corresponding to the pressure decrease profile of the washout alarm criterion. For instance, in FIG. 4, two alarm events 412, 414 may be detected based on detection of one or more profiles of decrease in pressure with respect to the flowrate 422 within the regions 402, 404. The comparison may filter out false positives of alarm event detection based on movement of drilling tool components. Such filtering may use cause and effect relationship between the drilling tool components. For example, normal operation of the drilling tool may include the bit depth and the block position moving in the same direction, and an abnormal operation of the drilling may include the bit depth and the block position moving in the opposite directions. The comparison may use moving directions of drilling tool components to provide context to measured pressure and flowrate, and filter out false positives of alarm event detection. Other detections of alarm events corresponding to the washout alarm criterion are contemplated.

Comparison of the operating characteristic(s) of the drilling tool with the set(s) of operating characteristics corresponding to the packoff alarm criterion may include analysis of pressure, flowrate, and/or other information to detect a particular increase in flowrate. Based on a certain amount, rate, and/or profile of increase in pressure for a flowrate, an alarm event corresponding to the packoff alarm criterion may be detected. The comparison may include use of signal processing and/or pattern recognition to determine when the pressure experienced an increase (e.g., actual increase in pressure, pressure remains steady when pressure decrease was expected, larger increase than expected, smaller decrease than expected) corresponding to the pressure increase profile of the washout alarm criterion. Other detections of alarm events corresponding to the packoff alarm criterion are contemplated.

Figure 5:
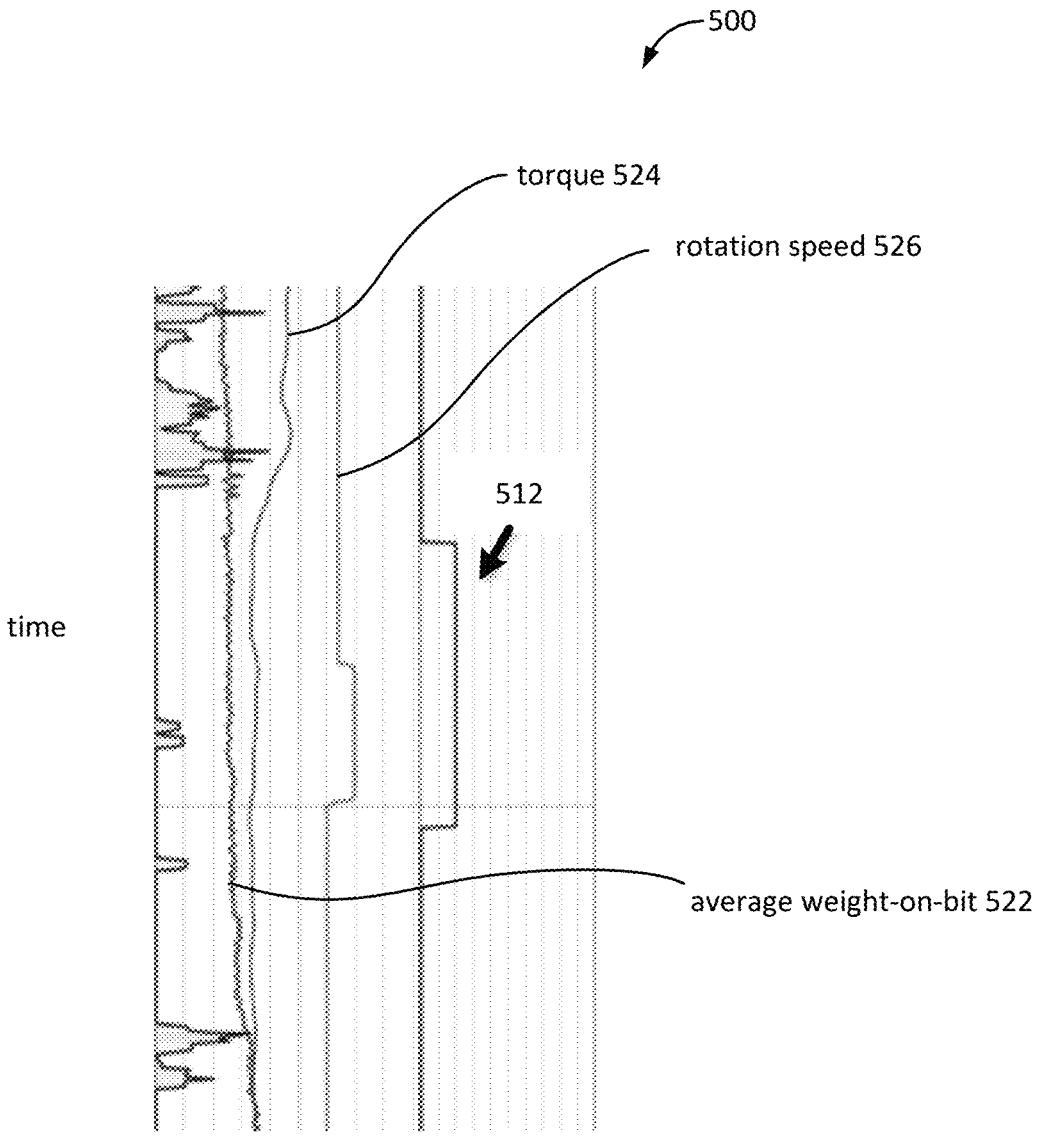
FIG. 5 illustrates example curves of weight-on-bit, torque, and rotation speed.

Comparison of the operating characteristic(s) of the drilling tool with the set(s) of operating characteristics corresponding to the weight-stacking alarm criterion may include analysis of rate-of-penetration, weight-on-bit, torque, rotation speed, and/or other information to determine when weight is not being properly being transferred to bottom hole assembly/bottom hole assembly component(s). The comparison may look for an event in which one or more of the following occur: the rate-of-penetration decreases to zero; a steady (constant, relatively constant) or an increase in weight-on-bit; a (significant) decrease in torque (TQA); and a steady (constant, relatively constant) rotation speed (rotation per minute). Based on the detection of such drilling parameters, an alarm event corresponding to the weight-stacking alarm criterion may be detected. For example, plot 500 of FIG. 5 illustrates example curves of average weight-on-bit 522, torque 524, and rotation speed 526 over time. The rate-of-penetration may be zero for the curves 522, 524, 526 shown in FIG. 5. An alarm event 512 may be detected based on the zero rate-of-penetration, steady/increase in average weight-on-bit 522, sharp decrease in torque 524, and steady rotation speed 526. Other detections of alarm events corresponding to the weight-stacking alarm criterion are contemplated.

Figure 6:
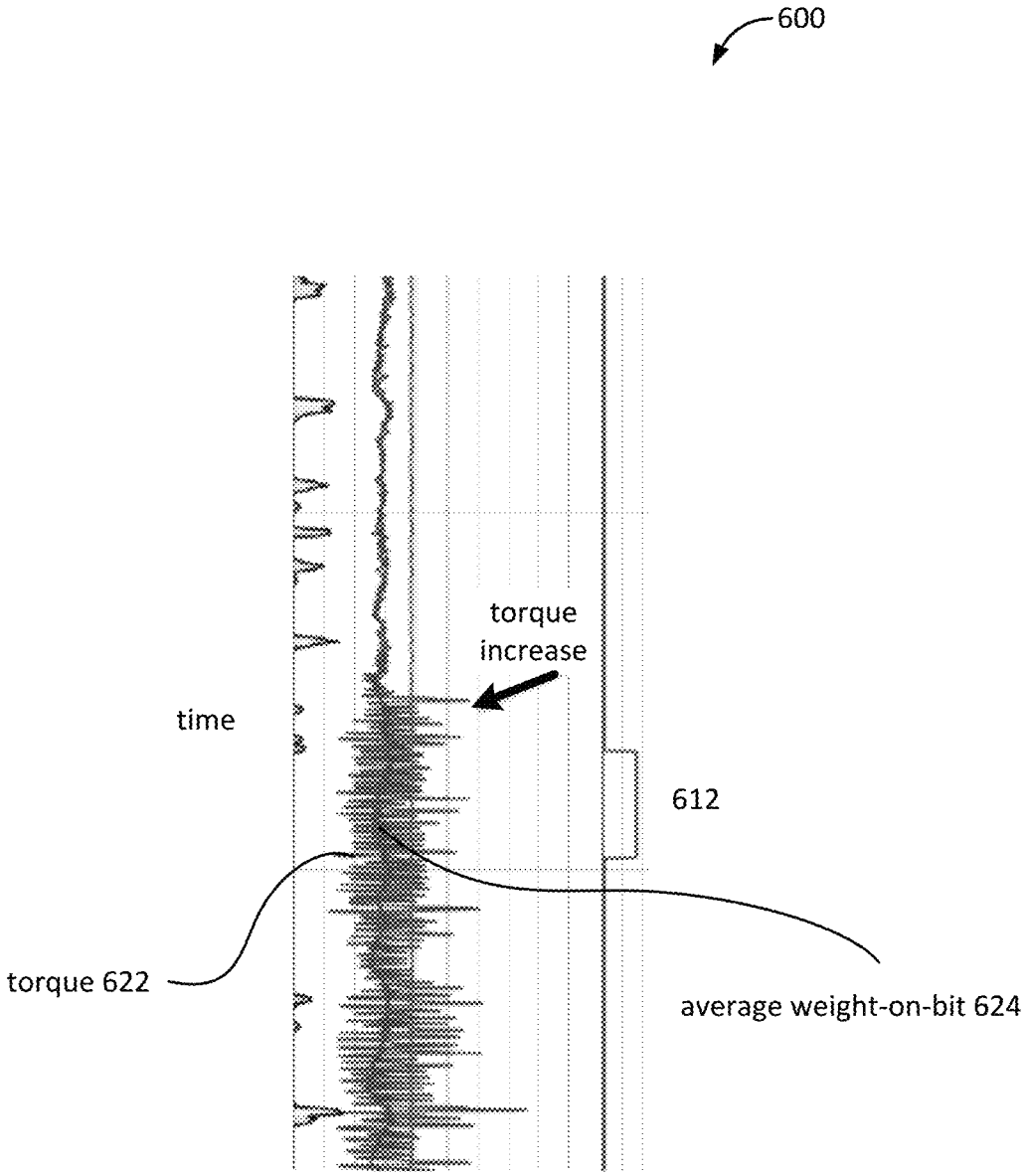
FIG. 6 illustrates example curves of torque and weight-on-bit.

Comparison of the operating characteristic(s) of the drilling tool with the set(s) of operating characteristics corresponding to the delta-torque alarm criterion may include analysis of torque, weight-on-bit, and/or other information to identify abnormal torque during drilling operation. The comparison may include trend analysis to identify when a particular deviation of torque from weight-on-bit occurs. Based on a certain amount, rate, and/or profile of deviation of the torque from the weight-on-bit, an alarm event corresponding to the delta-torque alarm criterion may be detected. For example, plot 600 of FIG. 6 illustrates example curves of torque 622 and average weight-on-bit 624 over time. The torque 622 may initially follow the average weight-on-bit 624, and then experience an increase that does not follow the average weight-on-bit 624. An alarm event 612 may be detected based on the increase of the torque 622 that does not follow the average weight-on-bit 624. Other detections of alarm events corresponding to the delta-torque alarm criterion are contemplated.

Comparison of the operating characteristic(s) of the drilling tool with the set(s) of operating characteristics corresponding to the torque alarm criterion may include analysis of the torque and/or other information to identify a change in torque that exceeds an expected variance. The comparison may include analysis of other operating parameters of the drilling tool to determine whether a change in torque may be attributed to one or more particular operations of the drilling tool. Based on the change in torque exceeding the expected variance (variance expected for operating parameters of the drilling tool), an alarm event corresponding to the torque alarm may be detected. Other detections of alarm events corresponding to the torque alarm criterion are contemplated.

Comparison of the operating characteristic(s) of the drilling tool with the set(s) of operating characteristics corresponding to the rate-of-penetration alarm criterion may include analysis of rate-of-penetration, rotation speed, weight-on-bit, and/or other information to determine change in formation encountered by the drilling tool. The comparison may look for an event in which one or more of the following occur: the rate-of-penetration decreases; a steady (constant, relatively constant) rotation speed (rotation per minute); and a steady (constant, relatively constant) weight-on-bit. Based on the detection of such drilling parameters, an alarm event corresponding to the rate-of-penetration alarm criterion may be detected. Detection of changes in rate-of-penetration with steady rotation speed and steady weight-on-bit may be used to determine the moments when the drilling tool begins drilling through different types of formations (from one type of formation to another type of formation). Detecting changes in formations may be facilitated through use of other operating parameters of the drilling tool. For example, the delta torque of the drilling tool may be used with the factors of the rate-of-penetration alarm criterion to determine when the formation being drilled by the drilling tool changes (e.g., from shale to non-shale). Other detections of alarm events corresponding to the rate-of-penetration alarm criterion are contemplated.

Comparison of the operating characteristic(s) of the drilling tool with the set(s) of operating characteristics corresponding to the reamer-in-tension-compression alarm criterion may include analysis of the weight-on-bit, the neutral weight, and/or other information to identify whether the reamer is in compression or tension with the bit. For example, based on the average weight-on-bit over a duration of time (e.g., 2 minutes) being less than the neutral weight, an alarm event corresponding to the reamer-in-tension-compression criterion may be detected.

Figure 7:
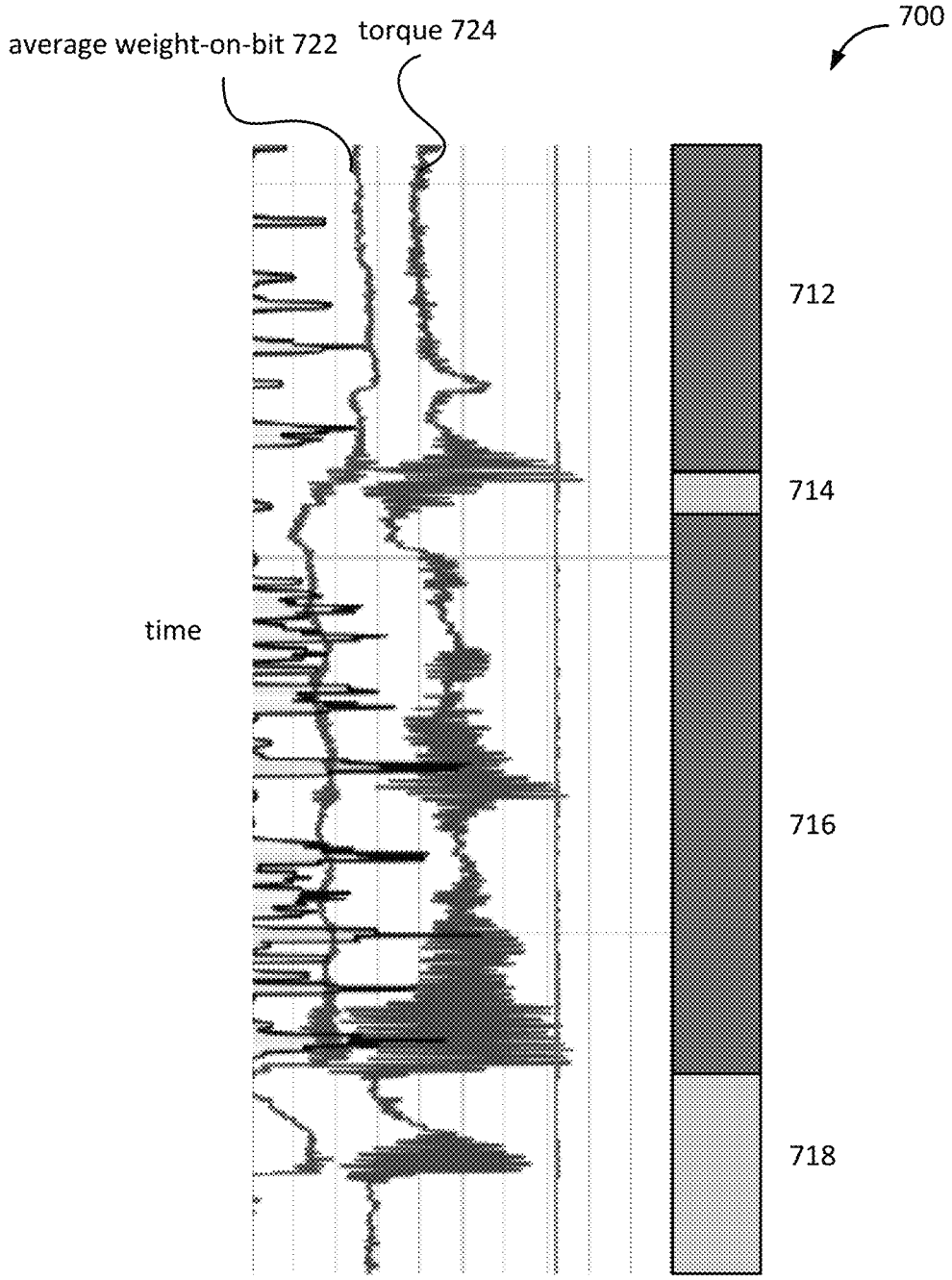
FIG. 7 illustrates example curves of weight-on-bit and torque.

For example, plot 700 of FIG. 7 illustrates example curves of average weight-on-bit 722 and torque 724 over time. As shown in FIG. 7, drop in average weight-on-bit 722 may result in large fluctuations of the torque 724 (e.g., generating large amounts of vibration), which may damage the drilling tool and/or cause the drilling operation to proceed at a slower pace. Based on the comparison of the average weight-on-bit 722 and the neutral weight over time, a portion 712 of the drilling operation may be identified has having the reamer in compression, a portion 716 of the drilling operation may be identified has having the reamer in tension (e.g., detection of an alarm event corresponding to the reamer-tension-compression alarm), and portions 714, 718 of the drilling operation may be identified as being off bottom. Other detections of alarm events corresponding to the reamer-tension-compression alarm criterion are contemplated.

Comparison of the operating characteristic(s) of the drilling tool with the set(s) of operating characteristics corresponding to the running-speed alarm criterion may include analysis of the rotation speed of a bottom hole assembly, and/or other information. Based on the rotation speed exceeding the maximum rotation speed for the bottom hole assembly, an alarm event corresponding to the running-speed alarm may be detected. Rotation speed exceeding the maximum rotation speed may result in formation breakage through surge effect. Other detections of alarm events corresponding to the running-speed alarm criterion are contemplated.

Comparison of the operating characteristic(s) of the drilling tool with the set(s) of operating characteristics corresponding to the drag alarm criterion may include trend analysis to identify when observed drag deviates from expected drag, modeled drag, historical drag, and/or known patterns of drag, and/or analysis of other information. A trend of observed drag may be compared to model curve(s) (e.g., planned curves, historical curves, known curves) of drag to identify certain deviations from the model curves.

Based on a certain amount, rate, and/or profile of deviation of the drag trend, an alarm event corresponding to the drag alarm criterion may be detected. An alarm event corresponding to the drag alarm criterion may be detected based on a certain trend change in the observed drag. The comparison may identify such deviation of the drag as an abnormal drag. Other detections of alarm events corresponding to the drag alarm criterion are contemplated.

The comparison may include adjustment of one or more models and/or model curves. For example, a model may provide an estimate of expected drag and/or other operating parameters based on estimated conditions of drilling. The model may not take into consideration acceleration and de-acceleration in string. During a drilling operation, the conditions of drilling may differ from those used in creating the model and the output of the model may no longer be valid and/or accurate. The comparison may include scanning of the model to determine assumptions made in the model (e.g., estimated conditions of drilling), determining the differences between the assumption in the model with actual conditions during drilling operation, and adjusting the output of the model based on the differences.

The comparison may adjust the model in real-time and/or near-real time. Friction factor may be calculated for each section per run to be used for future runs and/or planning. Maximum initial pickup for stand may be calculated when anomaly in observed drag is detected. The comparison may filter data of the drilling operation and/or the model in adjusting the output of the model. For example, acceleration and de-acceleration in hookload may be filtered based on weight and pipe movements. The running hookload may be adjusted in real-time/near real-time. The amount of observed drag may be plotted along with expected drag, and a trend of deviation of the observed drag from the expected drag may be used to detect an alarm event corresponding to the drag alarm criterion.

The comparison may use different drag analysis for opened ended trips and closed ended trips. The model may be generated based on one block weight, and may not compensate for closed ended trips. For closed ended trips, the required volume to fill the string may be calculated. The volume may be converted to weight, and the running hookload may be adjusted with the compensated weight.

For opened ended trips, the drag analysis may include calculation of the actual; block weight and comparison of the block weight with the block weight used in generation of the model. Interpolation between datapoints for models curves and between models with different friction factor may be performed. Comparison of the running hookload with models' hookload with different friction factors may be performed for individual stands. Friction factor may be calculated for individual stands by comparing the running hookload with the interpolated friction factor values. Minimum, maximum, average, and/or best match of friction factor for hole section may be calculated.

The drag analysis may differentiate between different phases of hookload. For example, the drag analysis may differentiate between initial pickup hookload, running hookload, ending hookload, and/or other hookloads. Filtering may be applied to select certain portions of hookload data for analysis and detection of an alarm event corresponding to the drag alarm criterion.

Comparison of the operating characteristic(s) of the drilling tool with the set(s) of operating characteristics corresponding to the pipe movement alarm criterion may include analysis of a duration in which the bottom hole assembly remains stationary within a depleted formation, and/or other information. Based on the bottom hole assembly remaining stationary within a depleted formation for a duration exceeding the maximum hold duration for the depleted formation, an alarm event corresponding to the pipe movement alarm may be detected. The comparison may include analysis of the type of depleted formation in which the bottom hole assembly is located and providing an advance warning as to the maximum duration of time the bottom hole assembly may stay within the depleted formation. For example, rather than providing a warning when the bottom hole assembly has remained stationary within a depleted formation for as long as or longer than the maximum hold duration for the depleted formation, a warning message that the bottom hole assembly is in a depleted formation (or a particular type of depleted formation) and that the bottom hole assembly should be moved within the maximum hold duration may be provided. Other detections of alarm events corresponding to the pipe movement alarm criterion are contemplated.

The alarm generation component 108 may be configured to, responsive to detection of an alarm event, generate an alarm for the alarm event. An alarm may be generated by as a warning of issues that may impact the operation of the drilling tool, such as a warning of potential degradation in drilling efficiency and/or potential non-productive time. The alarm may be generated local to and/or remote from the drilling tool. One or more steps of the alarm generation may be performed locally at and/or remote from the system 10. For example, the alarm generation component 108 may generate information defining the alarm and transmit the information (directly or indirectly) to another device, and the other device may store the information and/or present the alarm to one or more users using the information. The alarm generation component 108 may relay information about detection of an alarm event to another device, and the other device may generate an alarm based on the information. Other flow of information between and/or among devices for alarm generation are contemplated.

Generating an alarm for an alarm event may include creating one or more records of the occurrence of the alarm event. Generating an alarm for an alarm event may include providing information about the occurrence of the alarm event to one or more components of the system 10, one or more computing devices and/or one or more components of computing device(s) remote from the system 10, one or more users, and/or other entities/devices. Other generations of alarm are contemplated.

For example, generating an alarm for an alarm event may include setting and/or changing of one or more values (e.g., flag) indicating that the alarm event has occurred. Generating an alarm for an alarm event may include causing one or more messages (e.g., early warning message) to be provided to a user. A message may include information on the type of alarm event that was detected (e.g., tight-hole alarm event vs. a washout alarm event), information on operation characteristic(s) of the drilling tool and/or the alarm criterion that triggered the alarm, information on suggested steps to be taken for the drilling tool in response to the alarm event, and/or other information about the alarm event.

A message may include one or more visual portions, one or more audio portions, one or more haptic portions, and/or other portions. A visual portion of the message may include information that may be conveyed visually (e.g., text, image, graphic, video). Visual portions of the message may be provided via one or more display devices. An audio portion of the message may include information that may be conveyed audibly (e.g., sound, audio, voice, music). Audio portions of the message may be provided via one or more speaker devices. A haptic portion of the message may include information that may be conveyed via touch and/or motion (e.g., vibration, jerk). Haptic portions of the message may be provided via one or more haptic devices (e.g., motor).

Implementations of the disclosure may be made in hardware, firmware, software, or any suitable combination thereof. Aspects of the disclosure may be implemented as instructions stored on a machine-readable medium, which may be read and executed by one or more processors. A machine-readable medium may include any mechanism for storing or transmitting information in a form readable by a machine (e.g., a computing device). For example, a tangible computer-readable storage medium may include read-only memory, random access memory, magnetic disk storage media, optical storage media, flash memory devices, and others, and a machine-readable transmission media may include forms of propagated signals, such as carrier waves, infrared signals, digital signals, and others. Firmware, software, routines, or instructions may be described herein in terms of specific exemplary aspects and implementations of the disclosure, and performing certain actions.

In some implementations, some or all of the functionalities attributed herein to the system 10 may be provided by external resources not included in the system 10. External resources may include hosts/sources of information, computing, and/or processing and/or other providers of information, computing, and/or processing outside of the system 10.

Although the processor 11 and the electronic storage 13 are shown to be connected to the interface 12 in FIG. 1, any communication medium may be used to facilitate interaction between any components of the system 10. One or more components of the system 10 may communicate with each other through hard-wired communication, wireless communication, or both. For example, one or more components of the system 10 may communicate with each other through a network. For example, the processor 11 may wirelessly communicate with the electronic storage 13. By way of non-limiting example, wireless communication may include one or more of radio communication, Bluetooth communication, Wi-Fi communication, cellular communication, infrared communication, or other wireless communication. Other types of communications are contemplated by the present disclosure.

Although the processor 11 is shown in FIG. 1 as a single entity, this is for illustrative purposes only. In some implementations, the processor 11 may comprise a plurality of processing units. These processing units may be physically located within the same device, or the processor 11 may represent processing functionality of a plurality of devices operating in coordination. The processor 11 may be separate from and/or be part of one or more components of the system 10. The processor 11 may be configured to execute one or more components by software; hardware; firmware; some combination of software, hardware, and/or firmware; and/or other mechanisms for configuring processing capabilities on the processor 11.

It should be appreciated that although computer components are illustrated in FIG. 1 as being co-located within a single processing unit, one or more of computer program components may be located remotely from the other computer program components. While computer program components are described as performing or being configured to perform operations, computer program components may comprise instructions which may program processor 11 and/or system 10 to perform the operation.

While computer program components are described herein as being implemented via processor 11 through machine-readable instructions 100, this is merely for ease of reference and is not meant to be limiting. In some implementations, one or more functions of computer program components described herein may be implemented via hardware (e.g., dedicated chip, field-programmable gate array) rather than software. One or more functions of computer program components described herein may be software-implemented, hardware-implemented, or software and hardware-implemented The description of the functionality provided by the different computer program components described herein is for illustrative purposes, and is not intended to be limiting, as any of computer program components may provide more or less functionality than is described. For example, one or more of computer program components may be eliminated, and some or all of its functionality may be provided by other computer program components. As another example, processor 11 may be configured to execute one or more additional computer program components that may perform some or all of the functionality attributed to one or more of computer program components described herein.

The electronic storage media of the electronic storage 13 may be provided integrally (i.e., substantially non-removable) with one or more components of the system 10 and/or removable storage that is connectable to one or more components of the system 10 via, for example, a port (e.g., a USB port, a Firewire port, etc.) or a drive (e.g., a disk drive, etc.). The electronic storage 13 may include one or more of optically readable storage media (e.g., optical disks, etc.), magnetically readable storage media (e.g., magnetic tape, magnetic hard drive, floppy drive, etc.), electrical charge-based storage media (e.g., EPROM, EEPROM, RAM, etc.), solid-state storage media (e.g., flash drive, etc.), and/or other electronically readable storage media. The electronic storage 13 may be a separate component within the system 10, or the electronic storage 13 may be provided integrally with one or more other components of the system 10 (e.g., the processor 11). Although the electronic storage 13 is shown in FIG. 1 as a single entity, this is for illustrative purposes only. In some implementations, the electronic storage 13 may comprise a plurality of storage units. These storage units may be physically located within the same device, or the electronic storage 13 may represent storage functionality of a plurality of devices operating in coordination.

Figure 2:
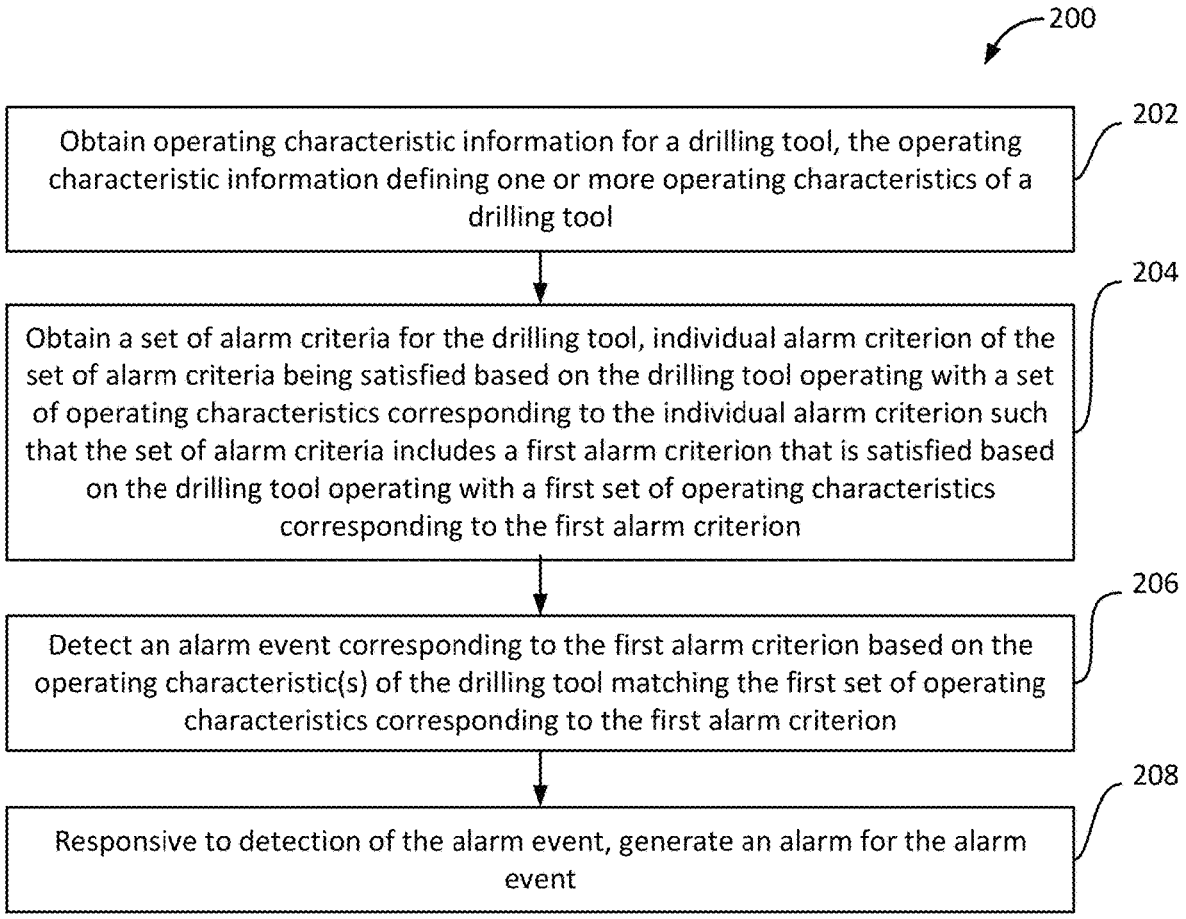
FIG. 2 illustrates an example method for generating alarms for a drilling tool.

FIG. 2 illustrates method 200 for generating alarms for a drilling tool. The operations of method 200 presented below are intended to be illustrative. In some implementations, method 200 may be accomplished with one or more additional operations not described, and/or without one or more of the operations discussed. In some implementations, two or more of the operations may occur substantially simultaneously.

In some implementations, method 200 may be implemented in one or more processing devices (e.g., a digital processor, an analog processor, a digital circuit designed to process information, a central processing unit, a graphics processing unit, a microcontroller, an analog circuit designed to process information, a state machine, and/or other mechanisms for electronically processing information). The one or more processing devices may include one or more devices executing some or all of the operation of method 200 in response to instructions stored electronically on one or more electronic storage mediums. The one or more processing devices may include one or more devices configured through hardware, firmware, and/or software to be specifically designed for execution of one or more of the operations of method 200.

Referring to FIG. 2 and method 200, at operation 202, operating characteristic information for a drilling tool may be obtained. The operating characteristic information may define one or more operating characteristics of a drilling tool. In some implementation, operation 202 may be performed by a processor component the same as or similar to the operating characteristic component 102 (Shown in FIG. 1 and described herein).

At operation 204, a set of alarm criteria for the drilling tool may be obtained. Individual alarm criterion of the set of alarm criteria may be satisfied based on the drilling tool operating with a set of operating characteristics corresponding to the individual alarm criterion such that the set of alarm criteria may include a first alarm criterion that is satisfied based on the drilling tool operating with a first set of operating characteristics corresponding to the first alarm criterion. In some implementation, operation 204 may be performed by a processor component the same as or similar to the alarm criteria component 104 (Shown in FIG. 1 and described herein).

At operation 206, an alarm event corresponding to the first alarm criterion may be detected based on the operating characteristic(s) of the drilling tool matching the first set of operating characteristics corresponding to the first alarm criterion. In some implementation, operation 206 may be performed by a processor component the same as or similar to the alarm event component 106 (Shown in FIG. 1 and described herein).

At operation 208, responsive to detection of the alarm event, an alarm for the alarm event may be generated. In some implementation, operation 208 may be performed by a processor component the same as or similar to the alarm generation component 108 (Shown in FIG. 1 and described herein).

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system for generating alarms, the system comprising:

one or more physical processors configured by machine-readable instructions to:

obtain operating characteristic information for a drilling tool, the operating characteristic information defining one or more operating characteristics of the drilling tool;

obtain a set of alarm criteria for the drilling tool, individual alarm criterion of the set of alarm criteria being satisfied based on the drilling tool operating with a set of operating characteristics corresponding to the individual alarm criterion such that the set of alarm criteria includes a first alarm criterion that is satisfied based on the drilling tool operating with a first set of operating characteristics corresponding to the first alarm criterion, wherein the set of alarm criteria includes a tight-hole alarm criterion and one or more of a washout alarm criterion, a packoff alarm criterion, a weight-stacking alarm criterion, a delta-torque alarm criterion, a torque alarm criterion, a rate-of-penetration alarm criterion, a reamer-tension-compression alarm criterion, a running-speed alarm criterion, a drag alarm criterion, and/or a pipe-movement alarm criterion, wherein the tight-hole alarm criterion includes different sets of operating characteristics for different operating conditions of the drilling tool such that the tight-hole alarm criterion includes a drilling operation set of operating characteristics for the drilling tool under drilling operation and a tripping operation set of operating characteristics for the drilling under tripping operation, the drilling operation set of operating characteristics different from the tripping operation set of operating characteristics, further wherein the set of operating characteristics corresponding to the tight-hole alarm criterion includes a trend of deviation of pick-up weight, the trend of deviation of the pick-up weight including the pick-up weight deviating from slack-off weight over drilling depth and/or drilling time;

detect an alarm event corresponding to the first alarm criterion based on the one or more operating characteristics of the drilling tool matching the first set of operating characteristics corresponding to the first alarm criterion; and responsive to detection of the alarm event, generate an alarm for the alarm event.

2. The system of claim 1, wherein the drilling operation set of operating characteristics for the drilling tool under the drilling operation includes bit depth being within 150 feet from hole depth and rotation speed being less than 5 rotations per minute, and the tripping operation set of operating characteristics for the drilling tool under the tripping operation includes the bit depth being between 150 feet and 800 feet from the hole depth and the rotation speed being less than 5 rotations per minute.

3. The system of claim 1, wherein the set of operating characteristics corresponding to the washout alarm criterion includes a decrease in pressure of flowrate in accordance with a washout profile.

4. The system of claim 3, wherein the set of operating characteristics corresponding to the washout alarm criterion further includes direction of bit depth movement to be opposite of direction of block position movement.

5. The system of claim 1, wherein the set of operating characteristics corresponding to the packoff alarm criterion includes an increase in pressure of flowrate in accordance with a packoff profile and movement direction of a first component of the drilling to be same or opposite of movement direction of a second component of the drilling tool.

6. The system of claim 1, wherein the set of operating characteristics corresponding to the weight-stacking alarm criterion includes a decrease in rate-of-penetration to zero, a steady or an increase in weight-on-bit, a change in torque, and a steady rotation speed, further wherein the set of operating characteristics corresponding to the weight-stacking alarm criterion includes a first set of factors for fully rotating sleeve and a second set of factors for non-rotating sleeve, the first set of factors different from the second set of factors.

7. The system of claim 1, wherein the set of operating characteristics corresponding to the delta-torque alarm criterion includes a deviation of torque from weight-on-bit, the set of operating characteristics corresponding to the delta-torque alarm criterion specifying types of separation of the torque from the weight-on-bit.

8. The system of claim 1, wherein the set of operating characteristics corresponding to the torque alarm criterion includes a change in torque exceeding an expected variance, the set of operating characteristics defining one or more relationships between drilling parameters and expected changes in torque to filter out false positives of a torque alarm event.

9. The system of claim 1, wherein the set of operating characteristics corresponding to the rate-of-penetration alarm criterion includes a decrease in rate-of-penetration, a steady rotation speed, and a steady weight-on-bit, wherein a change in formations encountered by the drilling tool is detected based on a rate-of-penetration alarm.

10. The system of claim 1, wherein the set of operating characteristics corresponding to the reamer-tension-compression alarm criterion includes an average of weight-on-bit over a duration being less than a neutral weight, the neutral weight including a weight of a reamer from a force of gravity acting on the reamer.

11. The system of claim 1, wherein the set of operating characteristics corresponding to the running-speed alarm criterion includes a rotation speed of a bottom hole assembly exceeding a maximum rotation speed.

12. The system of claim 1, wherein the set of operating characteristics corresponding to the drag alarm criterion includes a trend of deviation of drag.

13. The system of claim 1, wherein the set of operating characteristics corresponding to the pipe-movement alarm criterion includes a duration of no bottom hole assembly movement within a depleted formation exceeding a maximum hold duration for the depleted formation, the set of operating characteristics defining different values of the maximum hold duration for different types of formations, wherein a stuck-pipe event for the drilling tool is avoided based on a pipe-movement alarm.

14. A method for generating alarms, the method comprising:

obtaining operating characteristic information for a drilling tool, the operating characteristic information defining one or more operating characteristics of the drilling tool;

obtaining a set of alarm criteria for the drilling tool, individual alarm criterion of the set of alarm criteria being satisfied based on the drilling tool operating with a set of operating characteristics corresponding to the individual alarm criterion such that the set of alarm criteria includes a first alarm criterion that is satisfied based on the drilling tool operating with a first set of operating characteristics corresponding to the first alarm criterion, wherein the set of alarm criteria includes a tight-hole alarm criterion and one or more of a washout alarm criterion, a packoff alarm criterion, a weight-stacking alarm criterion, a delta-torque alarm criterion, a torque alarm criterion, a rate-of-penetration alarm criterion, a reamer-tension-compression alarm criterion, a running-speed alarm criterion, a drag alarm criterion, and/or a pipe-movement alarm criterion, wherein the tight-hole alarm criterion includes different sets of operating characteristics for different operating conditions of the drilling tool such that the tight-hole alarm criterion includes a drilling operation set of operating characteristics for the drilling tool under drilling operation and a tripping operation set of operating characteristics for the drilling under tripping operation, the drilling operation set of operating characteristics different from the tripping operation set of operating characteristics, further wherein the set of operating characteristics corresponding to the tight-hole alarm criterion includes a trend of deviation of pick-up weight, the trend of deviation of the pick-up weight including the pick-up weight deviating from slack-off weight over drilling depth and/or drilling time;

detecting an alarm event corresponding to the first alarm criterion based on the one or more operating characteristics of the drilling tool matching the first set of operating characteristics corresponding to the first alarm criterion; and responsive to detection of the alarm event, generating an alarm for the alarm event.

15. The method of claim 14, wherein the drilling operation set of operating characteristics for the drilling tool under the drilling operation includes bit depth being within 150 feet from hole depth and rotation speed being less than 5 rotations per minute, and the tripping operation set of operating characteristics for the drilling tool under the tripping operation includes the bit depth being between 150 feet and 800 feet from the hole depth and the rotation speed being less than 5 rotations per minute.

16. The method of claim 14, wherein the set of operating characteristics corresponding to the washout alarm criterion includes a decrease in pressure of flowrate in accordance with a washout profile.

17. The method of claim 16, wherein the set of operating characteristics corresponding to the washout alarm criterion further includes direction of bit depth movement to be opposite of direction of block position movement.

18. The method of claim 14, wherein the set of operating characteristics corresponding to the packoff alarm criterion includes an increase in pressure of flowrate in accordance with a packoff profile and movement direction of a first component of the drilling to be same or opposite of movement direction of a second component of the drilling tool.

19. The method of claim 14, wherein the set of operating characteristics corresponding to the weight-stacking alarm criterion includes a decrease in rate-of-penetration to zero, a steady or an increase in weight-on-bit, a change in torque, and a steady rotation speed, further wherein the set of operating characteristics corresponding to the weight-stacking alarm criterion includes a first set of factors for fully rotating sleeve and a second set of factors for non-rotating sleeve, the first set of factors different from the second set of factors.

20. The method of claim 14, wherein the set of operating characteristics corresponding to the delta-torque alarm criterion includes a deviation of torque from weight-on-bit, the set of operating characteristics corresponding to the delta-torque alarm criterion specifying types of separation of the torque from the weight-on-bit.

21. The method of claim 14, wherein the set of operating characteristics corresponding to the torque alarm criterion includes a change in torque exceeding an expected variance, the set of operating characteristics defining one or more relationships between drilling parameters and expected changes in torque to filter out false positives of a torque alarm event.

22. The method of claim 14, wherein the set of operating characteristics corresponding to the rate-of-penetration alarm criterion includes a decrease in rate-of-penetration, a steady rotation speed, and a steady weight-on-bit, wherein a change in formations encountered by the drilling tool is detected based on a rate-of-penetration alarm.

23. The method of claim 14, wherein the set of operating characteristics corresponding to the reamer-tension-compression alarm criterion includes an average of weight-on-bit over a duration being less than a neutral weight, the neutral weight including a weight of a reamer from a force of gravity acting on the reamer.

24. The method of claim 14, wherein the set of operating characteristics corresponding to the running-speed alarm criterion includes a rotation speed of a bottom hole assembly exceeding a maximum rotation speed.

25. The method of claim 14, wherein the set of operating characteristics corresponding to the drag alarm criterion includes a trend of deviation of drag.

26. The method of claim 14, wherein the set of operating characteristics corresponding to the pipe-movement alarm criterion includes a duration of no bottom hole assembly movement within a depleted formation exceeding a maximum hold duration for the depleted formation, the set of operating characteristics defining different values of the maximum hold duration for different types of formations, wherein a stuck-pipe event for the drilling tool is avoided based on a pipe-movement alarm.

* * * * *